US012467640B2

(12) United States Patent
D'Souza et al.

(10) Patent No.: US 12,467,640 B2
(45) Date of Patent: Nov. 11, 2025

(54) THICK FILM HEATING ASSEMBLY IN A PACKAGED TERMINAL AIR CONDITIONER UNIT

(71) Applicant: Haier US Appliance Solutions, Inc., Wilmington, DE (US)

(72) Inventors: Bryan Isaac D'Souza, Louisville, KY (US); Richard Dustin Henderson, La Grange, KY (US); Charles D. Robinson, III, Louisville, KY (US); Joshua Duane Longenecker, Louisville, KY (US); Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 307 days.

(21) Appl. No.: 17/953,646

(22) Filed: Sep. 27, 2022

(65) Prior Publication Data

US 2024/0102672 A1 Mar. 28, 2024

(51) Int. Cl.
*F24F 1/0375* (2019.01)

(52) U.S. Cl.
CPC ..... *F24F 1/0375* (2019.02)

(58) Field of Classification Search
CPC ..... F24F 1/0375; F24F 11/46; F24F 2110/10; F24F 2110/20; F24F 2140/12; F24F 2140/20; F24F 2221/54; F24F 1/0093; F24F 1/027; F24F 2221/34
See application file for complete search history.

(56) References Cited

U.S. PATENT DOCUMENTS

| | | | | |
|---|---|---|---|---|
| 11,118,794 | B1 * | 9/2021 | Mills et al. | F24F 1/0093 |
| 2007/0187076 | A1 * | 8/2007 | Martinus et al. | F24F 1/027 62/262 |
| 2020/0132320 | A1 * | 4/2020 | Shaffer | F24F 11/32 |
| 2021/0013706 | A1 * | 1/2021 | Richter et al. | H02G 3/081 |

FOREIGN PATENT DOCUMENTS

| | | | | |
|---|---|---|---|---|
| CN | 210568864 U | * | 5/2020 | F24F 1/0093 |
| DE | 102015203665 A1 | | 9/2016 | |
| JP | WO 2010064375 A1 | * | 6/2010 | F24F 1/0067 |
| KR | 20090022458 A | * | 3/2009 | B60H 1/2218 |
| KR | 20220055727 A | * | 5/2022 | B60H 1/3227 |
| WO | WO2010064375 A1 | | 6/2010 | |

OTHER PUBLICATIONS

CN 210568864 U Translation (Year: 2020).*
KR 20090022458 A Translation (Year: 2009).*
WO 2010064375 A1 Translation (Year: 2010).*
KR 20220055727 A Translation (Year: 2022).*

* cited by examiner

*Primary Examiner* — Jerry-Daryl Fletcher
*Assistant Examiner* — Dario Antonio Deleon
(74) *Attorney, Agent, or Firm* — Dority & Manning, P.A.

(57) ABSTRACT

An air conditioner unit and a film heating assembly for use in the air conditioner unit, the air conditioner unit comprising a bulkhead defining an indoor portion and an outdoor portion and an indoor fan positioned within the indoor portion for selectively urging a flow of air through an indoor heat exchanger. The film heating assembly comprises a plurality of thick film heaters mounted to the bulkhead and an electrical relay system for selectively coupling the plurality of thick film heaters to an external power source.

17 Claims, 9 Drawing Sheets

THICK FILM HEATING ASSEMBLY IN A PACKAGED TERMINAL AIR CONDITIONER UNIT

FIELD OF THE INVENTION

The present disclosure relates generally to air conditioner units, and more particularly to heating assemblies for use in packaged terminal air conditioner units.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected to another portion located outdoors, e.g., by tubing or conduit carrying refrigerant. These types of units are typically used for conditioning the air in larger spaces.

Another type of air conditioner unit, commonly referred to as single-package vertical units (SPVU) or package terminal air conditioners (PTAC), may be utilized to adjust the temperature in, for example, a single room or group of rooms of a structure. These units typically operate like split heat pump systems, except that the indoor and outdoor portions are defined by a bulkhead and all system components are housed within a single package that installed in a wall sleeve positioned within an opening of an exterior wall of a building.

When a conventional PTAC is operating in a cooling mode or a heating mode, a compressor circulates refrigerant within a sealed system, while indoor and outdoor fans urge flows of air across indoor and outdoor heat exchangers respectively. In this manner, the indoor air may be cooled or heated, respectively. However, conventional PTACs may also include a heater assembly that is positioned within the indoor portion for providing supplemental heating to the flow of indoor air when the PTAC is operating in the heating mode.

Typical heating assemblies include three parallel bare wire resistance heaters that present a problem in terms of uniform mixing of air and placement of thermal safety devices that react to the ambient temperatures around the air. In this regard, only a low percentage of the inlet air is convectively involved in pulling heat off the wire heaters. In addition, the heat flux comes off the heaters at all angles (e.g., 360 degrees about the heaters), which makes selecting proper thermal cutout locations for all scenarios difficult. Moreover, in the event of a flow blockage, the temperatures around these type of wire heaters and their placement between the indoor coil and the cross-flow fan can lead to very sensitive fault trips or unreliable thermal cutouts of power. To compensate, safety factors are increased which leads to higher cost and performance issues. These heater installations are also very difficult to assess for factory assembly and field service.

Accordingly, air conditioner units including improved heating assemblies would be useful. More specifically, a heating assembly for a PTAC that provides uniform heating and addresses one or more of the above-described challenges would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, an air conditioner unit defining a vertical direction, a lateral direction, and a transverse direction is provided. The air conditioner unit includes a cabinet, a bulkhead positioned within the cabinet and defining an indoor portion and an outdoor portion, a refrigeration loop comprising an outdoor heat exchanger positioned within the outdoor portion and an indoor heat exchanger positioned within the indoor portion, an indoor fan positioned within the indoor portion for selectively urging a flow of air through the indoor heat exchanger, and a film heating assembly mounted to the bulkhead for selectively heating the flow of air.

In another exemplary embodiment, a film heating assembly for an air conditioner unit is provided. The air conditioner unit includes a bulkhead defining an indoor portion and an outdoor portion and an indoor fan positioned within the indoor portion for selectively urging a flow of air through an indoor heat exchanger. The film heating assembly includes a plurality of thick film heaters mounted to the bulkhead and an electrical relay system for selectively coupling the plurality of thick film heaters to an external power source.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
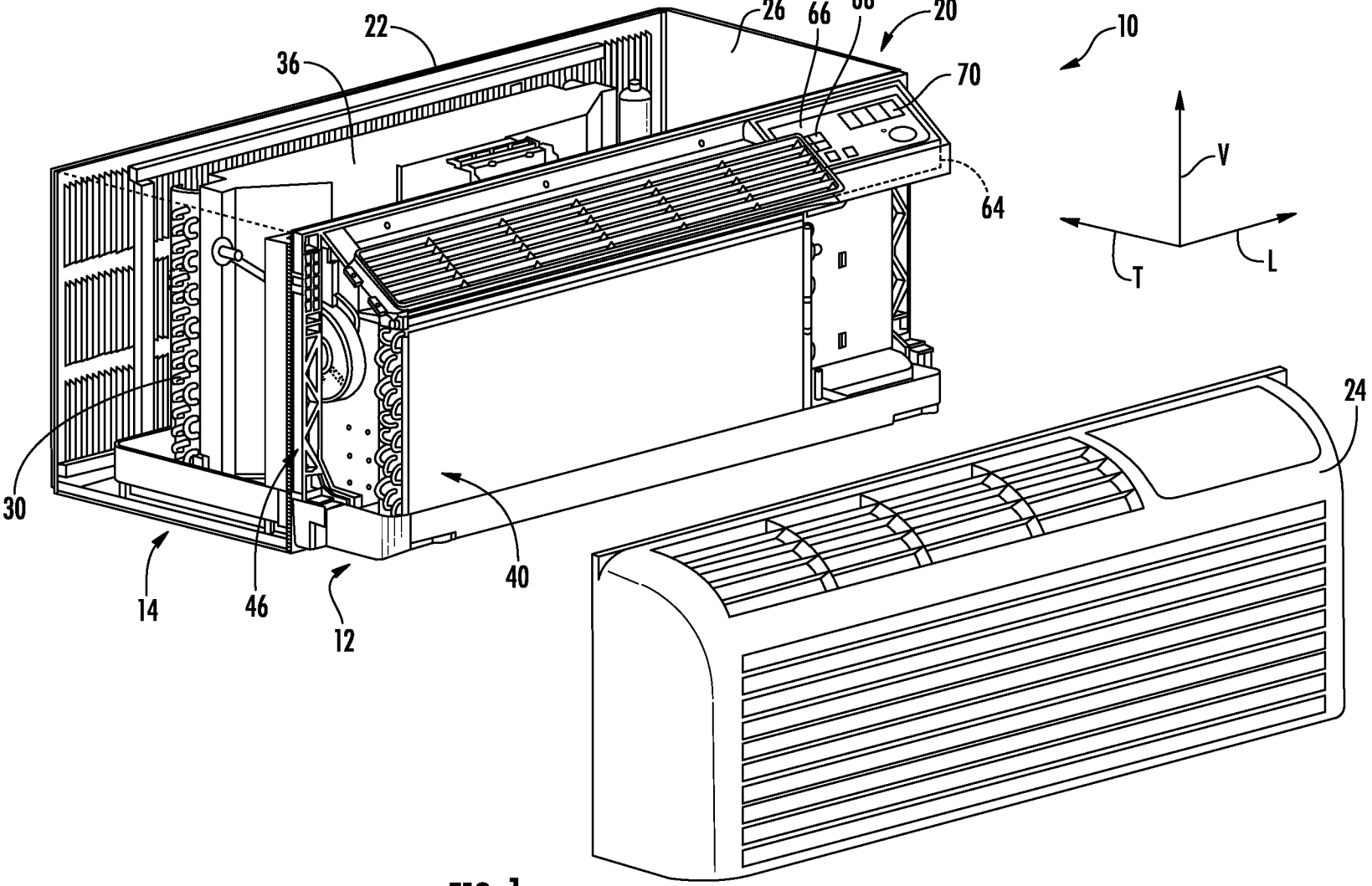
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
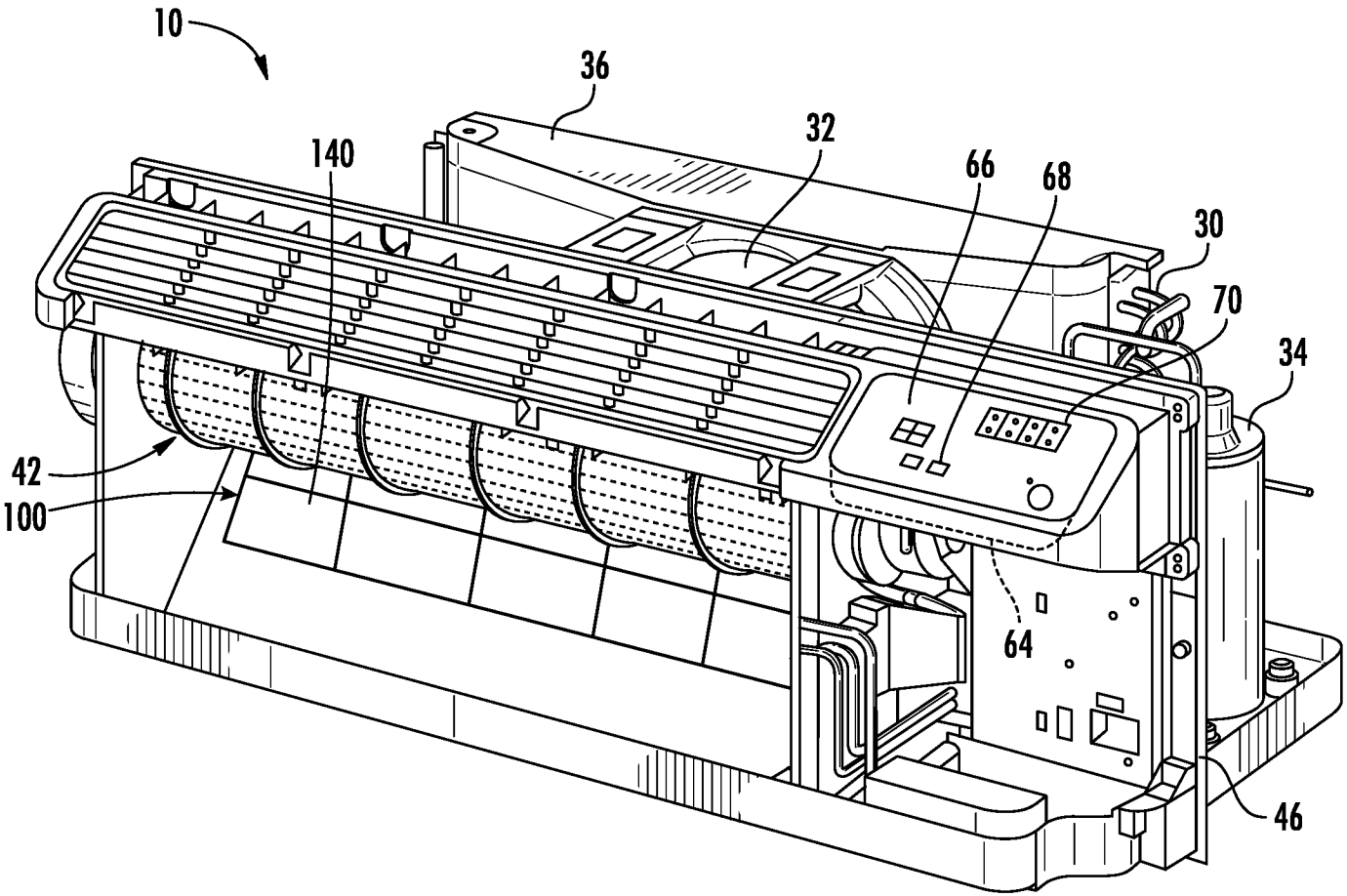
FIG. 2 is another perspective view of components of the indoor portion of the exemplary air conditioner unit of FIG. 1.

Referring now to FIGS. 1 and 2, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined. Although aspects of the present subject matter are described with reference to PTAC unit 10, it should be appreciated that aspects of the present subject matter may be equally applicable to other air conditioner unit types and configurations, such as single package vertical units (SPVUs) and split heat pump systems.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32, and a compressor 34 may be housed within the wall sleeve 26. A fan shroud 36 may additionally enclose outdoor fan 32, as shown.

Indoor portion 12 may include, for example, an indoor heat exchanger 40, a blower fan or indoor fan 42, etc. These components may, for example, be housed behind the room front 24. Additionally, a bulkhead 46 may generally support and/or house various other components or portions thereof of the indoor portion 12, such as indoor fan 42. Bulkhead 46 may generally separate and define the indoor portion 12 and outdoor portion 14.

Figure 3:
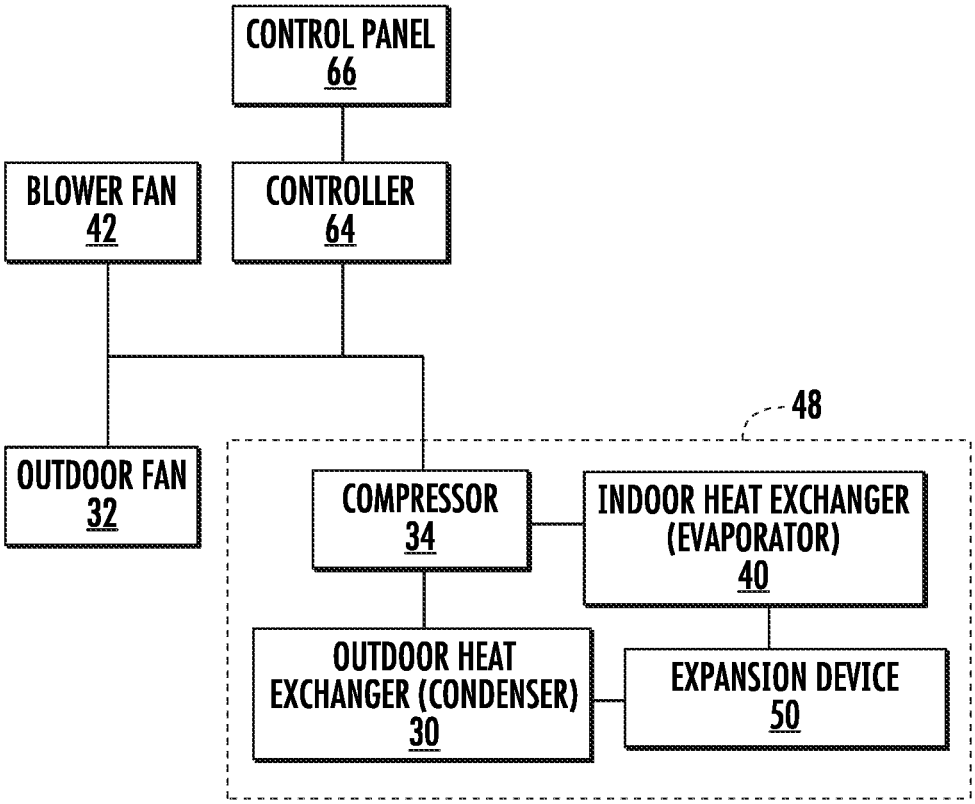
FIG. 3 is a schematic view of a refrigeration loop in accordance with one embodiment of the present disclosure.

Outdoor and indoor heat exchangers 30, 40 may be components of a sealed system or refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such examples and rather that any suitable refrigerant may be utilized.

As is understood in the art, refrigeration loop 48 may be alternately operated as a refrigeration assembly (and thus perform a refrigeration cycle) or a heat pump (and thus perform a heat pump cycle). As shown in FIG. 3, when refrigeration loop 48 is operating in a cooling mode and thus performing a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

Specifically, according to an exemplary embodiment, compressor 34 may be an inverter compressor. In this regard, compressor 34 may include a power inverter, power electronic devices, rectifiers, or other control electronics suitable for converting an alternating current (AC) power input into a direct current (DC) power supply for the compressor. The inverter electronics may regulate the DC power output to any suitable DC voltage that corresponds to a specific operating speed of compressor. In this manner compressor 34 may be regulated to any suitable operating speed, e.g., from 0% to 100% of the full rated power and/or speed of the compressor. This may facilitate precise compressor operation at the desired operating power and speed, thus meeting system needs while maximizing efficiency and minimizing unnecessary system cycling, energy usage, and noise.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve ("EEV") that enables controlled expansion of refrigerant, as is known in the art. According to alternative embodiments, expansion device 50 may be a capillary tube or another suitable expansion device configured for use in a thermodynamic cycle.

More specifically, according to exemplary embodiments, electronic expansion device 50 may be configured to precisely control the expansion of refrigerant to maintain, for example, a desired temperature differential of the refrigerant across the evaporator (i.e., the outdoor heat exchanger 30 in heat pump mode). In other words, electronic expansion device 50 throttles the flow of refrigerant based on the reaction of the temperature differential across the evaporator or the amount of superheat temperature differential, thereby ensuring that the refrigerant is in the gaseous state entering compressor 34.

In general, the terms "superheat," "operating superheat," or the like are generally intended to refer to the temperature increase of the refrigerant past the fully saturated vapor temperature in the evaporator. In this regard, for example, the superheat may be quantified in degrees Fahrenheit, e.g., such that 1° F. superheat means that the refrigerant exiting the evaporator is 1° F. higher than the saturated vapor temperature. It should be appreciated that the operating superheat may be measured and monitored by controller 64 in any suitable manner. For example, controller 64 may be operably coupled to a pressure sensor for measuring the refrigerant pressure exiting the evaporator, may convert that pressure to the saturated vapor temperature, and may subtract that temperature from the measured refrigerant temperature at the evaporator outlet to determine superheat.

According to exemplary embodiments, expansion device or electronic expansion valve 50 may be driven by a stepper motor or other drive mechanism to any desirable position between a fully closed position (e.g., when no refrigerant passes through EEV 50) to a fully open position (e.g., when there is little or no restriction through the EEV 50). For example, controller 64 may be operably coupled to EEV 50 and may regulate the position of the EEV 50 through a control signal to achieve a target superheat, a target restriction/expansion, etc.

More specifically, the control signal communicated from controller 64 may specify the number of control steps (or simply "steps") and a corresponding direction (e.g., counterclockwise toward the closed position or clockwise toward the open position). Each EEV 50 may have a physical stroke span equal to the difference between the fully open position and the fully closed position. In addition, the EEV 50 may include a step range or range of control steps that correspond to the number adjustment steps it take for the EEV 50 to travel from the fully closed position to the fully open position.

Each "step" may refer to a predetermined rotation of the drive mechanism, e.g., such as a stepper motor, which may in turn move the EEV 50 a fixed linear distance toward the open or closed position (depending on the commanded step direction). For example, according to the exemplary embodiment, the EEV 50 may have a step range of 500 steps, with 0 steps corresponding to fully closed and 500 steps corresponding to fully open. However, it should be appreciated that according to alternative embodiments, any given electronic expansion valve may include a different number of control steps, and the absolute step adjustments described herein may be varied accordingly.

In addition, as used herein, the position of EEV 50 may be expressed as a percentage, e.g., where 0% corresponds to a fully closed position and 100% corresponds to a fully open position. According to exemplary embodiments, this percentage representation may also refer to the percentage of total control steps taken from the closed position, e.g., with 10% referring to 50 steps (e.g., 10% of the 500 total steps), 80% referring to 400 steps (e.g., 80% of 500 total steps), etc.

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans, e.g., similar to variable speed compressor 34. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air. Alternatively, indoor fan 42 may be positioned upstream of indoor heat exchanger 40 along the flow direction of indoor air and may operate to push air through indoor heat exchanger 40.

The operation of air conditioner unit 10 including compressor 34 (and thus refrigeration loop 48 generally) indoor fan 42, outdoor fan 32, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66 and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
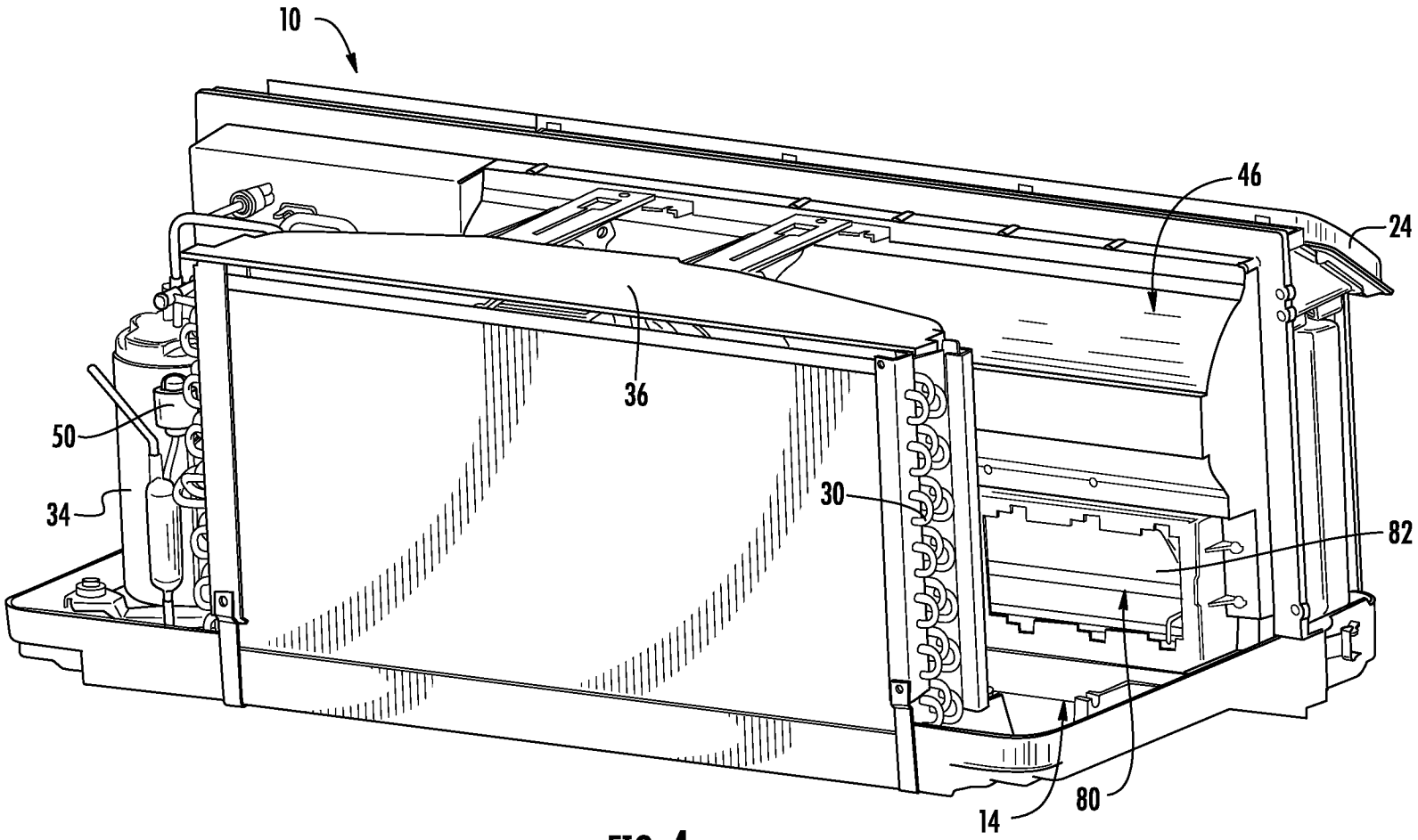
FIG. 4 is a rear perspective view of an outdoor portion of the exemplary air conditioner unit of FIG. 1, illustrating a vent aperture in a bulkhead in accordance with one embodiment of the present disclosure.

Referring briefly to FIG. 4, a vent aperture 80 may be defined in bulkhead 46 for providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, to compensate for negative pressure created within the room, etc. In this manner, according to an exemplary embodiment, make-up air may be provided into the room through vent aperture 80 when desired.

Figure 5:
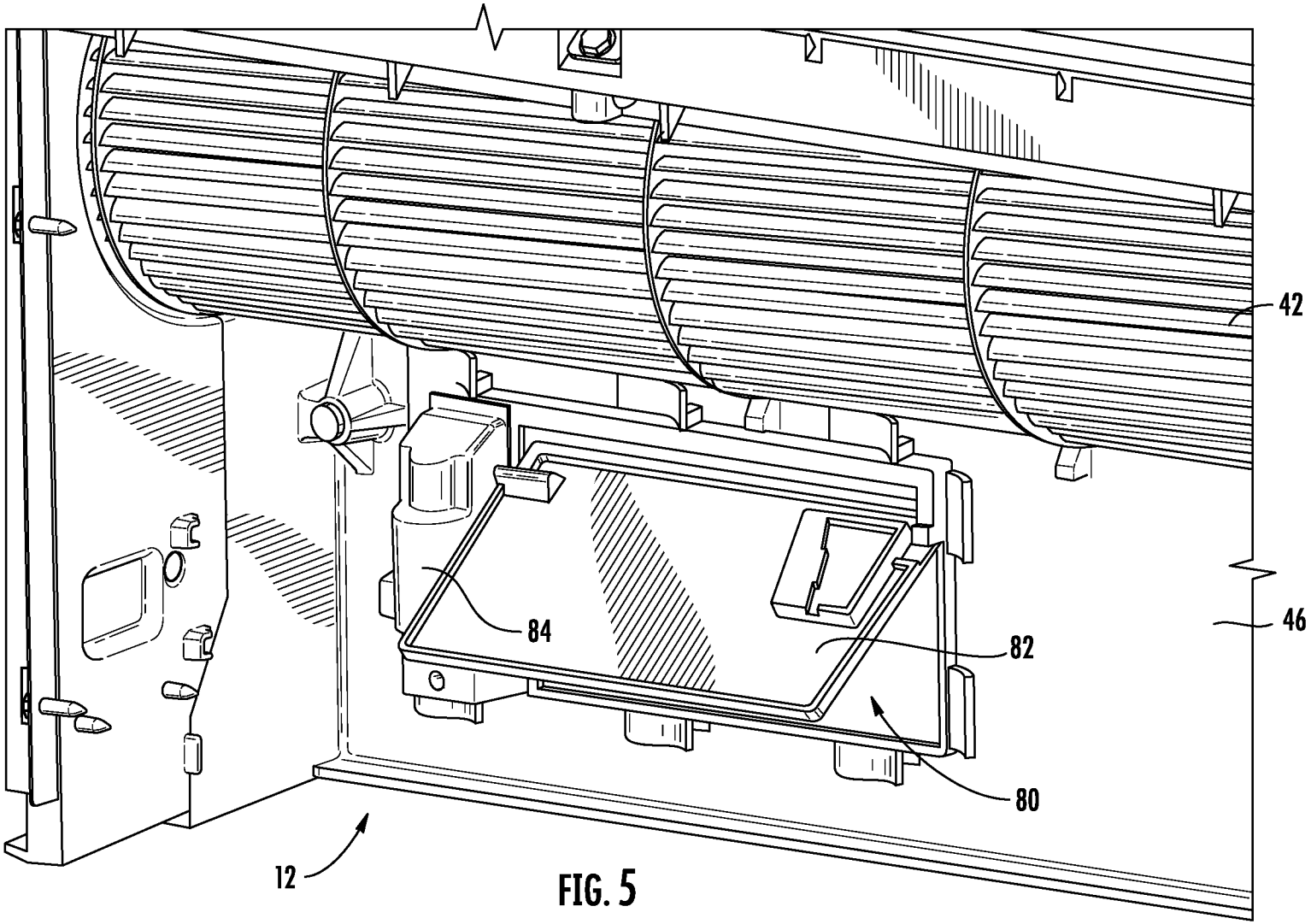
FIG. 5 is a front perspective view of the exemplary bulkhead of FIG. 4 with a vent door illustrated in the open position in accordance with one embodiment of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, according to an exemplary embodiment of the present subject matter, unit 10 may further include an auxiliary sealed system 90 (see FIG. 6) that is positioned over vent aperture 80 for conditioning make-up air. Auxiliary sealed system 90 may be a miniature sealed system that acts similar to refrigeration loop 48, but conditions only the air flowing through vent aperture 80. According to alternative embodiments, such as that described herein, make-up air may be urged through vent aperture 80 without the assistance of an auxiliary sealed system. Instead, make-up air is urged through vent aperture 80 may be conditioned at least in part by refrigeration loop 48, e.g., by passing through indoor heat exchanger 40. Additionally, the make-up air may be conditioned immediately upon entrance through vent aperture 80 or sequentially after combining with the air stream induced through indoor heat exchanger 40.

Figure 6:
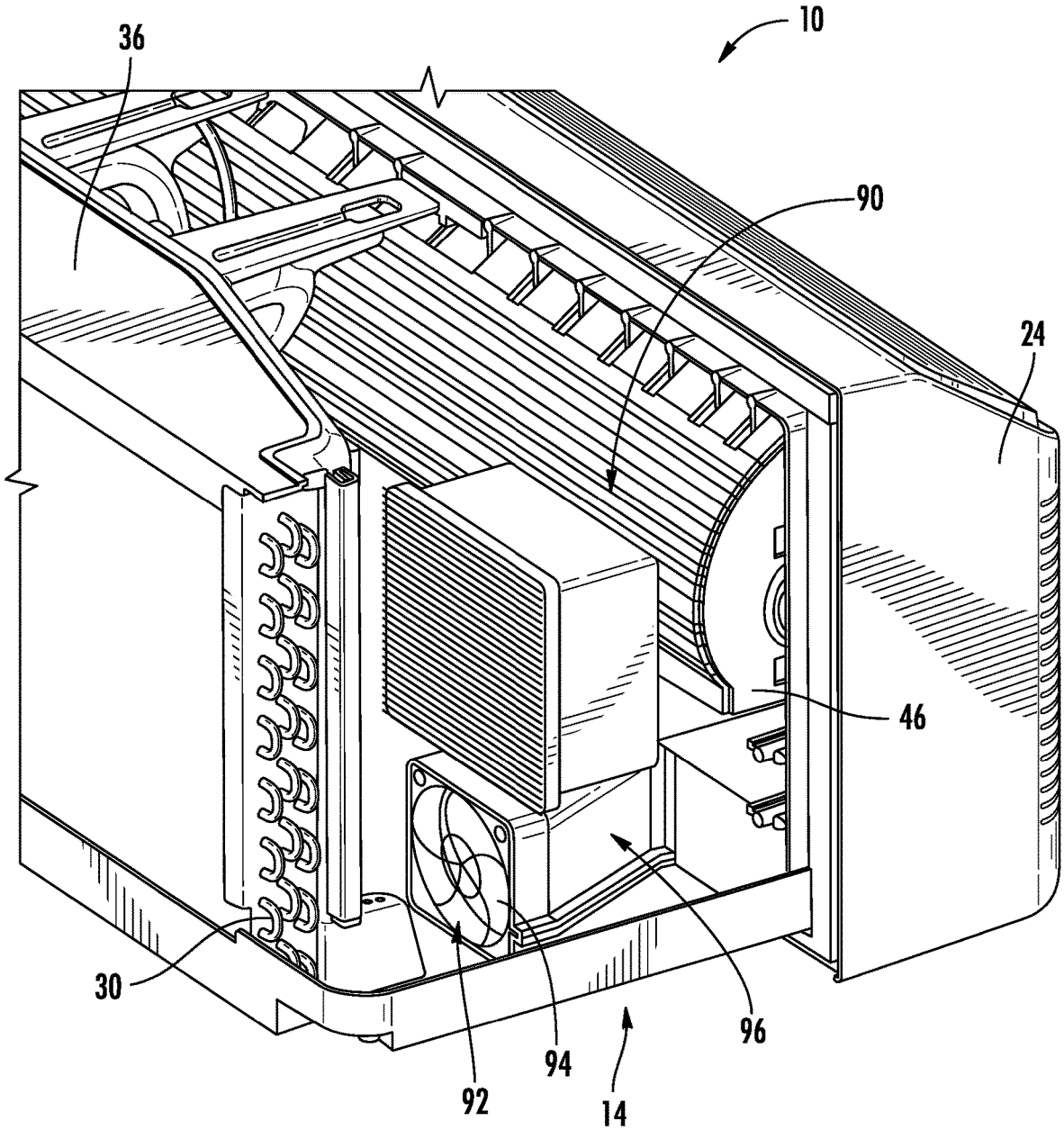
FIG. 6 is a rear perspective view of the exemplary air conditioner unit and bulkhead of FIG. 4 including a fan assembly for providing make-up air in accordance with one embodiment of the present disclosure.

As shown in FIG. 6, a fan assembly 92 may be operably coupled to auxiliary sealed system 90 and may be generally configured for urging the flow of makeup air through vent aperture 80 and into a conditioned room. However, it should be appreciated that fan assembly 92 could also be used independently from auxiliary sealed system 90 for urging a flow of make-up air. As illustrated, fan assembly 92 includes an auxiliary fan 94 for urging a flow of make-up air through a fan duct 96 and into indoor portion 12 through vent aperture 80.

According to the illustrated embodiment, auxiliary fan 94 is an axial fan positioned at an inlet of fan duct 96, e.g., upstream from vent aperture 80. However, it should be appreciated that any other suitable number, type, and configuration of fan or blower could be used to urge a flow of makeup air according to alternative embodiments. In addition, auxiliary fan 94 may be positioned in any other suitable location within air conditioner unit 10 and auxiliary fan 94 may be positioned at any other suitable location within or in fluid communication with fan duct 96. The embodiments described herein are only exemplary and are not intended to limit the scope present subject matter.

Referring now generally to FIGS. 7 through 11, a film heating assembly 100 that may be used with air conditioner unit 10 will be described according to example embodiments of the present subject matter. In general, film heating assembly 100 may be configured for selectively heating a flow of air (identified herein generally by reference numeral 102) passing through indoor portion 12 of air conditioner unit 10. More specifically, as illustrated, room front 24 of unit 10 generally defines an intake vent 104 and a discharge vent 106 for use in circulating a flow of air (indicated by arrows 102) throughout a room. In this regard, indoor fan 42 is generally configured for drawing in air 102 through intake vent 104 and urging the flow of air through indoor heat exchanger 40 and over film heating assembly 100 before discharging the air 102 out of discharge vent 106. According to the illustrated embodiment, intake vent 104 is positioned proximate a bottom of unit 10 and discharge vent 106 is positioned proximate a top of unit 10. However, it should be appreciated that according to alternative embodiments, intake vent 104 and discharge vent 106 may have any other suitable size, shape, position, or configuration.

Figure 7:
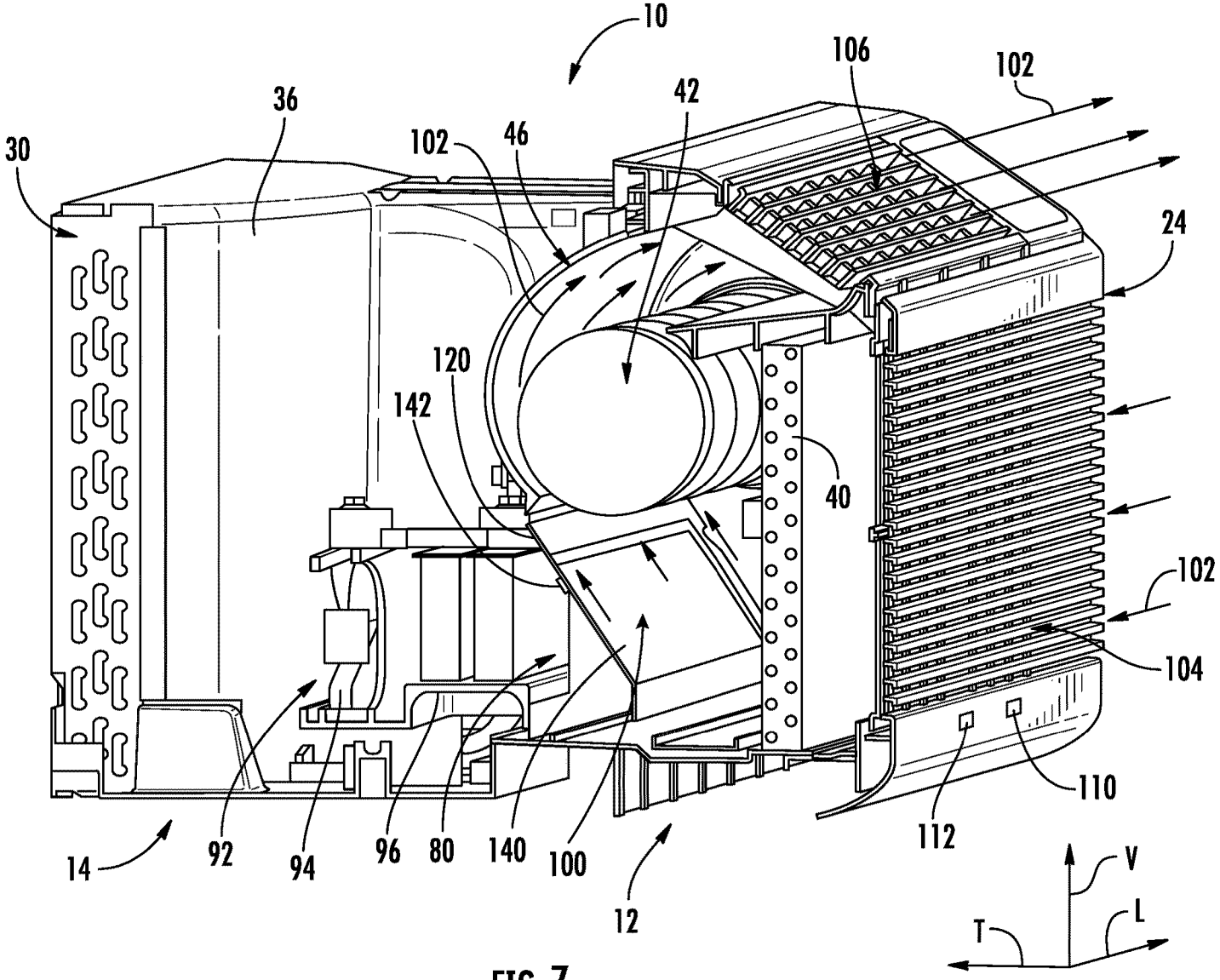
FIG. 7 is a side cross sectional view of the exemplary air conditioner unit of FIG. 1.

In order to facilitate operation of refrigeration loop 48 and other components of unit 10, unit 10 may include a variety of sensors for detecting conditions internal and external to the unit 10. These conditions can be fed to controller 64 which may make decisions regarding operation of unit 10 to rectify undesirable conditions or to otherwise condition the flow of air 102 into the room. For example, as best illustrated in FIG. 7, unit 10 may include an indoor temperature sensor 110 which is positioned and configured for measuring the indoor temperature within the room. In addition, unit 10 may include an indoor humidity sensor 112 which is positioned and configured for measuring the indoor humidity within the room. In this manner, unit 10 may be used to regulate the flow of air 102 into the room until the measured indoor temperature reaches the desired target temperature and/or humidity level. According to exemplary embodiments, unit 10 may further include an outdoor temperature sensor for measuring ambient outdoor temperatures.

As used herein, "temperature sensor" or the equivalent is intended to refer to any suitable type of temperature measuring system or device positioned at any suitable location for measuring the desired temperature. Thus, for example, temperature sensor 110 may each be any suitable type of temperature sensor, such as a thermistor, a thermocouple, a resistance temperature detector, a semiconductor-based integrated circuit temperature sensor, etc. In addition, temperature sensor 110 may be positioned at any suitable location and may output a signal, such as a voltage, to a controller that is proportional to and/or indicative of the temperature being measured. Although exemplary positioning of temperature sensors is described herein, it should be appreciated that unit 10 may include any other suitable number, type, and position of temperature, and/or other sensors according to alternative embodiments.

As used herein, the terms "humidity sensor" or the equivalent may be intended to refer to any suitable type of humidity measuring system or device positioned at any suitable location for measuring the desired humidity. Thus, for example, humidity sensor 112 may refer to any suitable type of humidity sensor, such as capacitive digital sensors, resistive sensors, and thermal conductivity humidity sensors. In addition, humidity sensor 112 may be positioned at any suitable location and may output a signal, such as a voltage, to a controller that is proportional to and/or indicative of the humidity being measured. Although exemplary positioning of humidity sensors is described herein, it should be appreciated that unit 10 may include any other suitable number, type, and position of humidity sensors according to alternative embodiments.

Film heating assembly 100 will now be described in more detail according to an exemplary embodiment of the present subject matter. As shown, film heating assembly 100 may generally be mounted such that it is positioned in thermal contact with the flow of air 102 passing through indoor portion 12. More specifically, according to the illustrated embodiment, film heating assembly 100 may be mounted to the bulkhead 46 of air conditioner unit 10. In this regard, film heating assembly 100 may generally be mounted in any suitable manner, such as by mechanical fasteners, adhesives, etc.

Specifically, according to the illustrated embodiment, film heating assembly 100 may be mounted to a heat shield 120 that forms a portion of bulkhead 46 or otherwise extends from bulkhead 46 into indoor portion 12. As illustrated, heat shield 120 is angled relative to the vertical direction V, such that film heating assembly 100 is positioned directly in the primary portion of the flow of air 102 and is capable of efficient heat transfer with the flow of air 102. It should be appreciated that other suitable mounting positions are possible and within the scope of the present subject matter.

In addition, it should be appreciated that bulkhead 46 and/or heat shield 120 may define any suitable recesses or pockets for facilitating improved mounting, improved heat distribution, or which may provide for a more compact appliance configuration. Specifically, according to the illustrated embodiment, heat shield 120 may define a recess 122 that is suitably sized for receiving film heating assembly 100. For example, film heating assembly 100 may be seated within recess 122 such that a top surface 124 of film heating assembly 100 may sit flush with heat shield 120. Film heating assembly 100 may be similarly situated when mounted directly to the vertical portion of bulkhead 46.

According to example embodiments, film heating assembly 100 may be positioned and oriented such that the heat flux (e.g., as identified generally by reference numeral 126) is efficiently directed into the flow of air 102 e.g., in a direction perpendicular to bulkhead 46 or heat shield 120. In this manner, the primary heat flux 126 may be directed into the high flow areas or into eddy currents formed by indoor fan 42. This introduction of heat may provide for improved temperature regulation of the flow of air 102.

Figure 8:
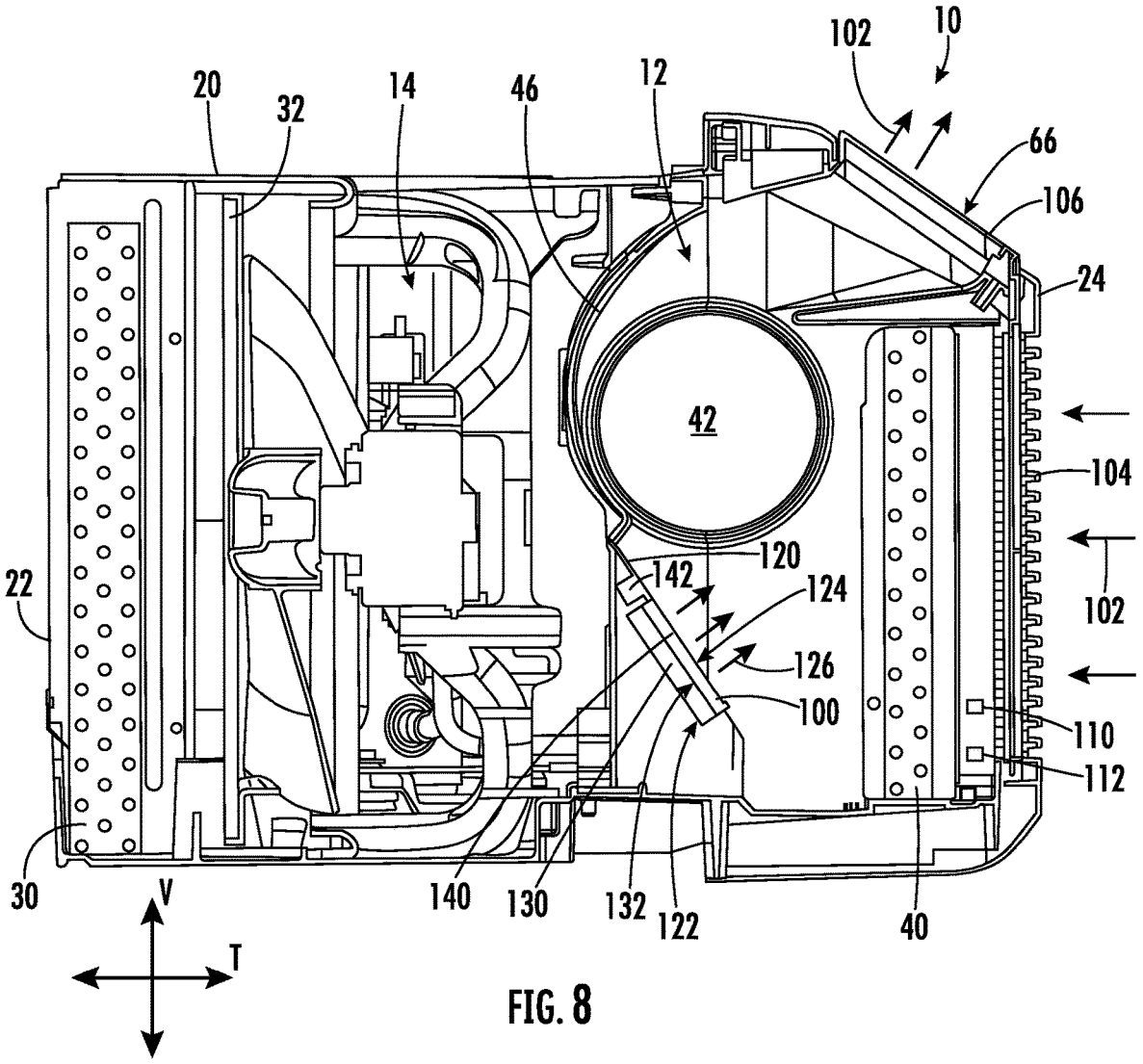
FIG. 8 is a side cross sectional view of the exemplary air conditioner unit of FIG. 1.

Referring specifically to FIG. 8, air conditioner unit 10 may further include an insulating member 130 positioned between the film heating assembly 100 and bulkhead 46 or heat shield 120. In this regard, for example, insulating member 130 may be made from a thermally insulating material such that heat is prevented from passing through a back surface 132 of film heating assembly 100 or is otherwise urged directly along the heat flux 126 line as shown in FIG. 8. According to an example embodiment, recess 122 may be sized to accommodate both insulating member 130 and film heating assembly 100.

As shown, film heating assembly 100 is positioned under indoor fan 42 and extends along a width of bulkhead 46 along the lateral direction L. Indeed, according to example embodiments, film heating assembly 100 may extend across most or all of the width of air conditioner unit 10, e.g., such as across greater than 50%, greater than 75%, greater than 90%, or greater than 95% of the appliance width. In addition, as explained above, indoor fan 42 may have a tendency to create eddy currents downstream of indoor heat exchanger 40 and upstream of indoor fan 42. According to the illustrated embodiment, film heating assembly 100 is positioned in between indoor heat exchanger 40 and indoor fan 42 to efficiently transmit thermal energy into the flow of air 102, e.g., as stimulated by the eddy currents.

Although film heating assembly 100 is illustrated as being positioned on bulkhead 46 immediately upstream of indoor fan 42, it should be appreciated that other suitable placements are possible and within the scope of the present subject matter. Indeed, the versatility and flexibility of film heating assembly 100 make many other locations possible. For example, film heating assembly 100 may be alternatively positioned downstream of indoor fan 42, e.g., proximate to discharge vent 106.

In general, film heating assembly 100 may include any suitable number, type, configuration, geometry, and positioning of film heaters while remaining within the scope of the present subject matter. For example, according to example embodiments, film heating assembly 100 may include one or more thick film heaters 140. As used herein, "thick film heaters" may refer generally to resistance heating elements that are formed as films, e.g., films that have a very low dimensional ratio (e.g., thickness over cross-sectional area). For example, a thick film heater 140 may include a stainless steel or ceramic substrate, an insulation layer deposited or printed on the substrate, and one or more layers of electrically resistive paste or covering. Other suitable coverings or treatments, such as a top enamel layer or attachment adhesives may be applied while remaining within the scope of the present subject matter. Other suitable constructions would be understood by one having ordinary skill in the art.

Figure 9:
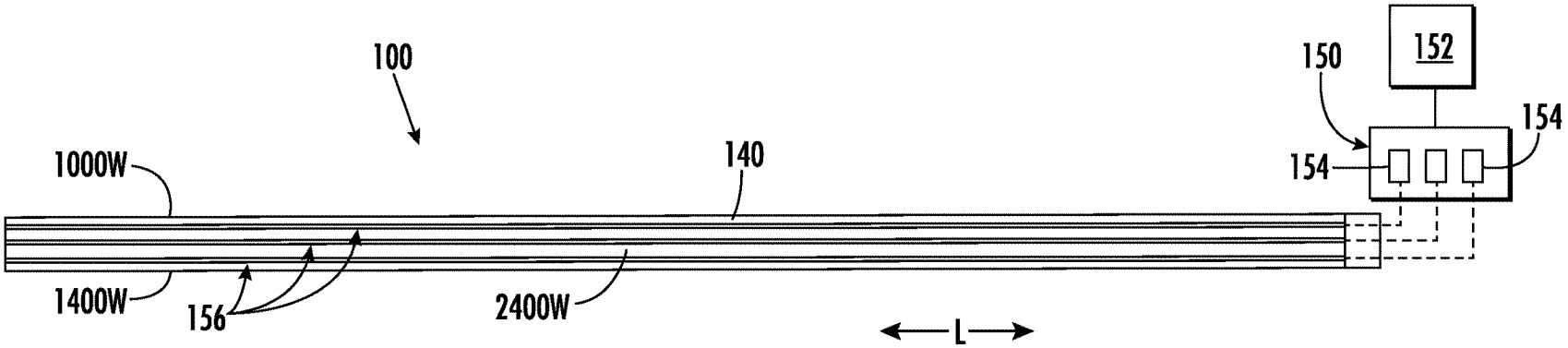
FIG. 9 illustrates a heater configuration that may be used in the exemplary air conditioner unit of FIG. 1 according to an example embodiment of the present subject matter.
Figure 10:
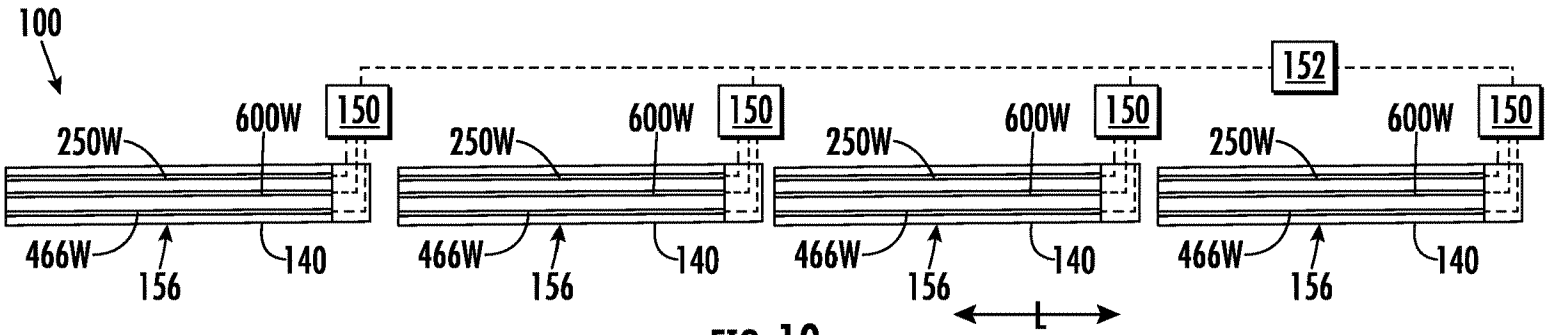
FIG. 10 illustrates a heater configuration that may be used in the exemplary air conditioner unit of FIG. 1 according to an example embodiment of the present subject matter.
Figure 11:
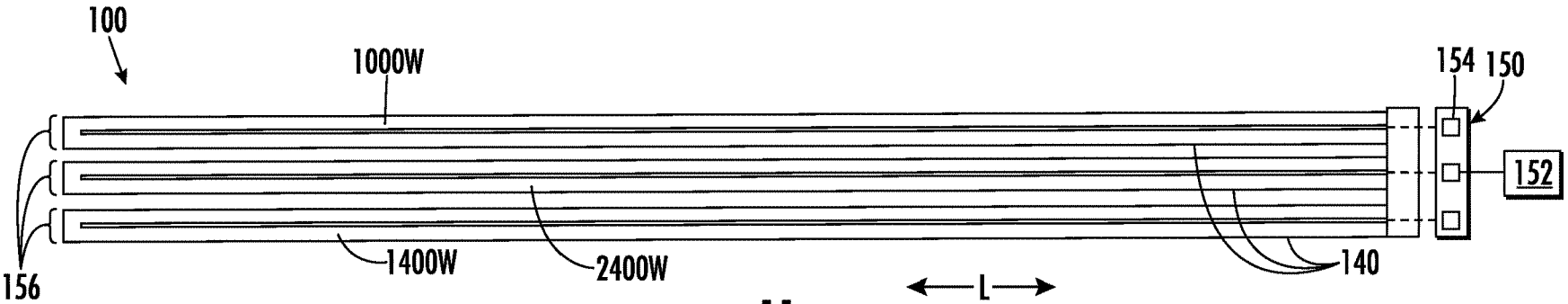
FIG. 11 illustrates a heater configuration that may be used in the exemplary air conditioner unit of FIG. 1 according to an example embodiment of the present subject matter.

In addition, it should be appreciated that the size and operating wattages of each of the thick film heaters 140 may vary as needed depending on the application. For example, as shown in FIGS. 9 through 11, thick film heaters 140 may include multiple resistive elements, each of which may have a specific operating wattage, and each of these resistive elements may be selectively coupled to a power source (as described below) to vary the overall heat generated by the thick film heater 140. In addition, each of the thick film heaters 140 may be independently regulated to provide improved heating versatility and heating performance.

According to example embodiments, air conditioner unit 10 may include a variety of temperature measuring devices to monitor the operation of film heating assembly 100, e.g., to ensure optimal appliance performance and to prevent safety issues. For example, if the flow of air 102 is blocked or indoor fan 42 stops working for some reason, the heat build-up in film heating assembly 100 may result in a hazardous situation, e.g., introducing a risk of fire, burns, etc. Accordingly, according to an example embodiment, air conditioner unit 10 may further include a thermal cutoff switch 142 mounted adjacent film heating assembly 100 for cutting power to the film heating assembly 100 when a predetermined temperature is reached. This predetermined temperature may be a safety threshold set by the manufacturer, programmed by the user, or determined in any other suitable manner.

In general, it may be desirable to maintain close proximity between film heating assembly 100 and thermal cutoff switch 142, e.g., for accurate temperature detection and quick reaction times. Accordingly, as illustrated, thermal cutoff switch 142 is mounted within heat shield 120 immediately downstream of film heating assembly 100. According to still other embodiments, thermal cutoff switch 142 may be mounted in direct contact with film heating assembly 100. Notably, such contact would not be permissible with conventional nichrome wire heat banks.

In addition to the thin size and versatility of placement of thick film heaters 140, these thick film heaters 140 may be sized and configured in a way that facilitates great versatility in heating. In this regard, as shown for example in FIGS. 9 through 11, air conditioner unit 10 may include an electrical relay system 150 for selectively coupling the plurality of thick film heaters 140 to an external power source (illustrated schematically by reference numeral 152). In this regard, for example, electrical relay system 150 may include a plurality of electrical relays 154, each being electrically coupled to one of the thick film heaters 140. In this manner, a controller (e.g., such as controller 64) may selectively open/close electrical relays 154 to power selected thick film heaters 140, while leaving others off or reducing their heat output. In addition, according to example embodiments, electrical relay system 150 may regulate the precise power level of each thick film heater 140.

By utilizing controller 64 to operate electrical relay system 150 to regulate the plurality of thick film heaters 140, heat may be precisely applied to the flow of air 102 at the desired locations. Indeed, the plurality of thick film heaters 140 may define two or more independent heating zones (identified generally by reference numeral 156 in FIGS. 10 and 11). These heating zones 156 may vary along the lateral direction L, along the vertical direction V, along the transverse direction T, etc.

As explained above, aspects of the present subject matter are generally directed to an air conditioner that includes a series of thick film heaters installed as an insert assembly into the heat shield under the indoor crossflow fan. The film heater may be oriented to direct heat flux downward into the eddy stream under the fan and thermal cut-outs may be placed behind or adjacent to heaters such that loss of flow will result in immediate heat movement into the thermal cut-outs. The thick film heaters can provide high watt density variety of ways to create lateral and horizontal zones of heat flux. These film heaters can be printed on the thin substrate and can be used as an insert into or as part of the heat shield under the indoor fan and may run laterally across its entire length. Thermal cut-outs may be placed on the film heater to curtail the air flow.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical direction, a lateral direction, and a transverse direction, the air conditioner unit comprising:

a housing;

a bulkhead positioned within the housing and defining an indoor portion and an outdoor portion, wherein the bulkhead defines a recess;

a refrigeration loop comprising an outdoor heat exchanger positioned within the outdoor portion and an indoor heat exchanger positioned within the indoor portion;

an indoor fan positioned within the indoor portion for selectively urging a flow of air through the indoor heat exchanger; and a film heating assembly mounted to the bulkhead for selectively heating the flow of air, wherein the film heating assembly is mounted within the recess such that a top surface of the film heating assembly sits flush with the bulkhead, wherein the film heating assembly comprises:

a plurality of film heaters, wherein each of the plurality of film heaters defines two or more independent heating zones along the lateral direction; and an electrical relay system for selectively coupling the plurality of film heaters to an external power source.

2. The air conditioner unit of claim 1, wherein the film heating assembly is mounted to a heat shield that extends from the bulkhead.

3. The air conditioner unit of claim 1, further comprising:

an insulating member positioned between the film heating assembly and the bulkhead.

4. The air conditioner unit of claim 1, wherein the film heating assembly is oriented to direct heat flux in a direction perpendicular to bulkhead.

5. The air conditioner unit of claim 1, wherein the film heating assembly is positioned under the indoor fan and extending along a width of the bulkhead along the lateral direction.

6. The air conditioner unit of claim 1, wherein the film heating assembly is positioned downstream of the indoor fan.

7. The air conditioner unit of claim 1, wherein the film heating assembly comprises a film heater.

8. The air conditioner unit of claim 1, wherein at least two of the plurality of film heaters having different operating wattages.

9. The air conditioner unit of claim 1, further comprising:

a thermal cutoff switch mounted adjacent the film heating assembly for cutting power to the film heating assembly when a predetermined temperature is reached.

10. The air conditioner unit of claim 9, wherein the thermal cutoff switch is mounted within the bulkhead downstream of the film heating assembly.

11. The air conditioner unit of claim 9, wherein the thermal cutoff switch is in direct contact with the film heating assembly.

12. The air conditioner unit of claim 1, wherein the air conditioner unit is a single-package vertical unit (SPVU) or a package terminal air conditioner (PTAC).

13. The air conditioner unit of claim 1, wherein the film heating assembly is positioned on the bulkhead upstream of the indoor fan.

14. A film heating assembly for an air conditioner unit, the air conditioner unit comprising a bulkhead defining an indoor portion and an outdoor portion and an indoor fan positioned within the indoor portion for selectively urging a flow of air through an indoor heat exchanger, the film heating assembly comprising:

a plurality of film heaters mounted within a recess defined by the bulkhead such that a top surface of the film heating assembly sits flush with the bulkhead, wherein each of the plurality of film heaters defines two or more independent heating zones along a lateral direction; and an electrical relay system for selectively coupling the plurality of film heaters to an external power source.

15. The film heating assembly of claim 14, further comprising:

an insulating member positioned between the film heating assembly and the bulkhead.

16. The film heating assembly of claim 14, wherein at least two of the plurality of film heaters having different operating wattages.

17. The film heating assembly of claim 14, further comprising:

a thermal cutoff switch mounted adjacent the film heating assembly for cutting power to the film heating assembly when a predetermined temperature is reached.

* * * * *